US007342571B2

(12) United States Patent
Fraser et al.

(10) Patent No.: US 7,342,571 B2
(45) Date of Patent: Mar. 11, 2008

(54) INTERCHANGEABLE DISPLAY MODULES FOR PORTABLE HANDHELD DEVICES

(75) Inventors: Sherridythe A. Fraser, San Jose, CA (US); Shawn R. Gettemy, San Jose, CA (US); Kevin Lee, San Jose, CA (US); Yoon Kean Wong, Redwood City, CA (US); Lawrence Lam, San Jose, CA (US)

(73) Assignee: Palm, Inc., Santa Clara, CA (US)

( * ) Notice: Subject to any disclaimer, the term of this patent is extended or adjusted under 35 U.S.C. 154(b) by 845 days.

(21) Appl. No.: 10/085,310

(22) Filed: Feb. 28, 2002

(65) Prior Publication Data

US 2003/0160771 A1 Aug. 28, 2003

(51) Int. Cl.
*G09G 5/00* (2006.01)

(52) U.S. Cl. ..... 345/169

(58) Field of Classification Search ..... 345/169, 345/168, 178, 730, 204, 205; 361/679, 686; 710/12, 13; 348/848; 340/572.1, 568.1; 235/901, 462.13

See application file for complete search history.

(56) References Cited

U.S. PATENT DOCUMENTS

| | | | | |
|---|---|---|---|---|
| 4,763,291 | A | 8/1988 | Schwaber | |
| 4,856,088 | A | 8/1989 | Oliwa et al. | |
| 4,916,441 | A | 4/1990 | Gombrich | |
| 5,128,662 | A | 7/1992 | Failla | |
| 5,416,310 | A | 5/1995 | Little | |
| 5,515,303 | A | 5/1996 | Cargin, Jr. et al. | |
| 5,579,487 | A * | 11/1996 | Meyerson et al. | 710/100 |
| 5,781,177 | A * | 7/1998 | Helot et al. | 345/156 |
| 5,850,209 | A | 12/1998 | Lemke et al. | |
| 5,953,734 | A * | 9/1999 | Tanaka | 715/541 |
| 5,999,990 | A | 12/1999 | Sharrit et al. | |
| 6,084,584 | A | 7/2000 | Nahi et al. | |
| 6,098,877 | A | 8/2000 | Barkan et al. | |
| 6,115,618 | A | 9/2000 | Lebby et al. | |
| 6,238,344 | B1 | 5/2001 | Gamelsky et al. | |
| 6,266,240 | B1 | 7/2001 | Urban et al. | |
| 6,271,815 | B1 | 8/2001 | Yang et al. | |
| 6,317,313 | B1 | 11/2001 | Mosgrove et al. | |
| 6,356,442 | B1 | 3/2002 | Lunsford | |
| 6,356,443 | B2 | 3/2002 | Jenks et al. | |
| 6,590,547 | B2 * | 7/2003 | Moriconi et al. | 345/30 |

(Continued)

OTHER PUBLICATIONS

Pfeiffer, Andreas, *The Future of Electronic Paper*, ZDNet News, dated May 11, 2001, pp. 1-3, printed from the Internet site: http://www.zdnet/zdnn/stories/comment/0,5859,2717791,00 . . . on Oct. 3, 2001.

(Continued)

*Primary Examiner*—Richard Hjerpe
*Assistant Examiner*—Abbas I. Abdulselam
(74) *Attorney, Agent, or Firm*—Foley & Lardner LLP

(57) ABSTRACT

A handheld computing device featuring interchangeable display units is disclosed. The handheld computing device includes a processing unit and a visual display unit detachable from the processing unit. The processing unit and the detachable visual display unit include communication ports capable of communicating with each other. The processing unit further can receive information representative of the properties of the detachable visual display unit.

26 Claims, 2 Drawing Sheets

U.S. PATENT DOCUMENTS

| | | | | |
|---|---|---|---|---|
| 6,628,257 | B1 * | 9/2003 | Oka et al. | 345/97 |
| 6,639,790 | B2 * | 10/2003 | Tsai et al. | 361/683 |
| 6,690,337 | B1 | 2/2004 | Mayer, III et al. | |
| 2001/0005201 | A1 | 6/2001 | Digiorgio et al. | |
| 2003/0071832 | A1 | 4/2003 | Branson | |

OTHER PUBLICATIONS

*Turning a New Page—Books Go Electronic*, p. 1, printed from the Internet site: http://www.eink.com/solutions/publishing.htm on Oct. 3, 2001.

*E-Paper Moves a Step Nearer*, BBC News, dated Apr. 23, 2001, pp. 1-3, printed from the Internet site: http://news.bbc.co.uk/hi/english/sci/tech/newsid_1292000/129285 . . . on Oct. 3, 2001.

*Electronic Reusable Paper*, pp. 1-3, printed from the Internet site: http://www.parc.xerox.com/dhl/projects/gyricon and http://www.parc.xerox.com/dhl/projects/gyricon/images/thing-ep.jpg on Oct. 3, 2001.

Mann, Charles, *Electronic Paper Turns the Page*, Technology Review, dated Mar. 2001, pp. 1-10, printed from the Internet site: http://www.technologyreview.com/magazine/mar01/mann.asp on Oct. 3, 2001.

Jacobson, Dr. Joseph M., et al., *Electronic Paper: Electronic Paper Books and Electronic Books*, pp. 1-2, printed from the Internet site: http://www.media.mit.edu/micromedia/elecpaper.html on Oct. 3, 2001.

*Panasonic Unveils PC with Wireless Display*, Itworld.com, dated Jun. 26, 2001, pp. 1-3, printed from the Internet site: http/www.itworld.com/Comp/1290/IDG010626panasonic/ on Oct. 3, 2001.

*Panasonic Introduces Ruggedized Handheld with Integrated Keyboard and Touchscreen Surface*, dated Sep. 24, 2001, pp. 1-4, printed from the Internet site: http://www.panasonic.com/ciomputer/notebook/html/05¯apdrc.asp? . . . on Oct. 3, 2001.

Definition of Handheld Computer, printed from the website: http//dictionary.reference.com, dated Feb. 11, 2004.

Definition of Handheld, printed from the website: http//searchmobilecomputing.techtarget.com, dated Feb. 11, 2004.

* cited by examiner

INTERCHANGEABLE DISPLAY MODULES FOR PORTABLE HANDHELD DEVICES

CROSS REFERENCE TO RELATED APPLICATIONS

The present application is related to U.S. patent application No. 10/085,945, entitled DETACHABLE EXPANDABLE FLEXIBLE DISPLAY, and U.S. patent application Ser. No. 10/085,924, entitled WIRELESS DETACHABLE DISPLAY, both of which are filed on the same day herewith and assigned to the same assignee as the present application and are both herein incorporated by reference.

BACKGROUND

The present invention relates generally to the field of handheld computing devices. More particularly, the disclosure relates to interchangeable display modules for a handheld computing device.

Handheld computing devices usually display data stored in memory or generated by a processor on a visual display built into the handheld computing device that is slightly smaller than the size of the handheld computing device. The size of the handheld computing device is generally compact and correspondingly, the visual display is smaller than the size of a standard computer monitor. The small size of the screen allows handheld computing devices to be portable, but less than ideal for viewing complex images of documents. The small size of the screen has necessitated that handheld computing devices focus on displaying abbreviated or simplistic content.

The abbreviated or simplistic display content has not conventionally been a problem because handheld computing devices have also had limited computing power. When handheld computing devices were introduced, most people were using the devices for relatively simple applications. Traditional applications may have included an address book, a daily planner, or other similar applications that were generally not graphic intensive. These applications worked well with the smaller display screens.

However, the processing speed of handheld computing devices as well as other capabilities have been experiencing significant improvements. Handheld computing devices have improved in processor power, battery life, weight, etc. As a consequence of these improvements, handheld computing devices are now running applications that formerly could only be run on a full personal computer.

There have also been improvements in display screen technology. The resolution and depth of color of the built in display screen has dramatically improved. However, the built in display continues to be necessarily relatively small. The small display is advantageous when the user of the handheld computing device seeks portability. However, although the compact size offers size and weight advantages, it may be undesirable to display the full content of a screen normally displayed on a 15 inch cathode ray tube (CRT) computer monitor, on a traditional handheld computing device screen. However, increasing the size of the traditional display screen would cause a corresponding increase in the size and weight of the handheld computing device.

Additionally, the technological evolution of the handheld computing device and the display screen do not proceed in lockstep. Currently, a user seeking to buy an improved processor is forced to purchase an entirely new handheld computing device. This is true despite the possibility that the visual display of the new handheld computing device may be the same as the one built into the old handheld computing device. The same concept applies wherein the user seeks to upgrade a display.

Accordingly, there is a need for a handheld computing device that can communicate with a plurality of visual displays based upon the user's current needs. There is also a need for a handheld computing device having a detachable display such that the user can upgrade either a processing unit or display unit. Further, there is a need for a method for a handheld computing device that can be used to recognize and communicate with a plurality of detachable visual display units.

It would be desirable to provide a system and/or method that provides one or more of these or other advantageous features. Other features and advantages will be made apparent from the present specification. The teachings disclosed extend to those embodiments which fall within the scope of the appended claims, regardless of whether they accomplish one or more of the aforementioned needs.

SUMMARY

An exemplary embodiment of the invention relates to a handheld computing device. The handheld computing device includes a processing unit having a communication interface. The processing unit includes a first communication interface for communication with a visual display unit. The handheld computing device also includes a detachable visual display unit that is communicatively coupled to the first communication interface by a second communication interface. An identifier indicia is passed by the second communication interface to the processing unit via the first communication interface to indicate to the processing unit the properties of the detachable visual display unit.

Another exemplary embodiment relates to a handheld computing device facilitating a detachable visual display unit. The handheld computing device includes a processing unit, a power source, and a communication port for communicating with a detachable visual display unit.

Yet another exemplary embodiment relates to a visual display unit for a handheld computing device. The visual display unit includes a housing detachable from the handheld computing device, a display screen, and a communication interface including an identifier indicia to indicate to the handheld computing device the properties of the visual display unit.

Still yet another exemplary embodiment relates to a method of displaying data from a handheld computing device. The method includes detecting the properties of a detachable visual display unit communicatively coupled to the handheld computing device. The method also includes updating display drivers based on the detachable visual display unit properties detected, and transmitting data from the handheld computing device to the communicatively coupled detachable visual display unit.

Alternative exemplary embodiments relate to other features and combination of features as may be generally recited in the claims.

BRIEF DESCRIPTION OF THE DRAWINGS

The invention will become more fully understood from the following detailed description, taken in conjunction with the accompanying drawings, wherein like reference numerals refer to like elements, in which.

DETAILED DESCRIPTION OF PREFERRED AND EXEMPLARY EMBODIMENTS

A handheld computing device including interchangeable display modules is described. In the following description, for purposes of explanation, numerous specific details are set forth to provide a through understanding of exemplary embodiments of the invention. It will be evident, however, to one skilled in the art that the invention may be practiced without these specific details. In other instances, structures and devices are shown in block diagram or other illustrative forms to facilitate description of the exemplary embodiments.

Figure 1A:
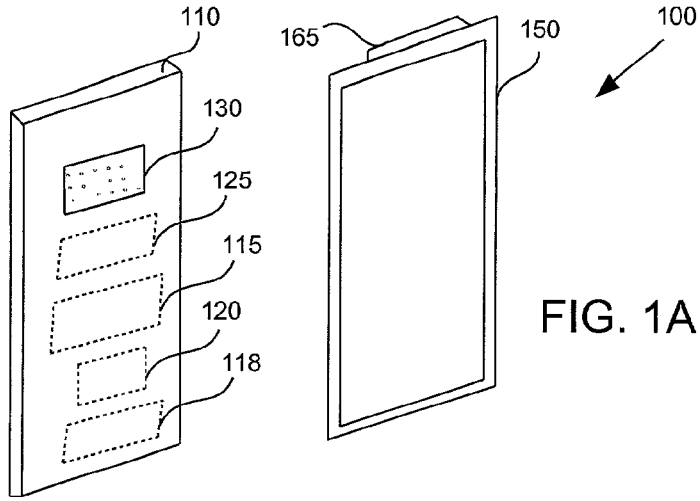
FIG. 1A is a generalized illustration of a handheld computing device including a processing unit and a detachable visual display unit according to an exemplary embodiment.

FIG. 1A is a generalized illustration of a handheld computing device 100. Handheld computing device 100 includes a processing unit 110 and a visual display unit 150 in accordance with an exemplary embodiment. Visual display unit 150 is shown detached from processing unit 110.

Processing unit 110 can be a handheld computer, a handheld personal digital assistant (PDA), a wireless mobile phone, a pager, or any other such device. Processing unit 110 can include a processor 115, a display controller 118, a power supply 120, a memory unit 125, and a connection port 130.

Processor 115 can be any microprocessor capable of accessing information stored in memory unit 125, performing actions based on instructions using information from memory unit 125 or some other source, and alternatively storing information in memory unit 125 or transmitting information. An example of transmitting information can be sending information to be displayed on display unit 150. Transmission can be internal to another component of handheld computing device 110, or external to some other device.

Power source 120 can be a battery or fuel cell, a direct line from a wall outlet, current from a solar cell or any other power source sufficient to satisfy the power requirements for handheld computing device 100. Memory unit 125 can be any form of data storage. It may be at least one of random access memory (RAM) and/or read only memory (ROM). Information can be stored permanently until overwritten and/or stored temporarily for use while the unit is active.

Connection port 130 can be any type of connection capable of sending data to and receiving data from visual display unit 150. According to an exemplary embodiment, connection port 130 can be a 24 pin input jack that mates with a mating connection port on visual display unit 150.

According to an alternative exemplary embodiment, connection port 130 can be a wireless transceiver. According to the alternative embodiment, processing unit 110 can send to and receive data from a mating wireless transceiver associated with visual display unit 150 wirelessly while the units are detached. The wireless transceivers can utilize the Infrared Direct Access (IrDA) protocol, the Bluetooth short range radio network protocol, the IEEE 802.11 protocol, the HomeRF single wireless access protocol, the IEEE 802.11b wireless fidelity protocol, or any other protocol for sending information wirelessly from processing unit 110 to visual display unit 150.

Visual display unit 150 can include a visual display capable of displaying data transmitted from processing unit 110. Visual display unit 150 can include a LCD screen, e-paper (such as eInk, Smart Paper™ by Gyricon Media, APD™ by Citala, etc.), or other bi-stable display, a CRT display or any other type of visual display. Visual display unit 150 can include a display connection port 155.

Display connection port 155 can be any type of connection port that can communicate with connection port 130. According to an alternative embodiment, display port 155 can be a wireless connection port as describe above in reference to connection port 130.

Figure 1B:
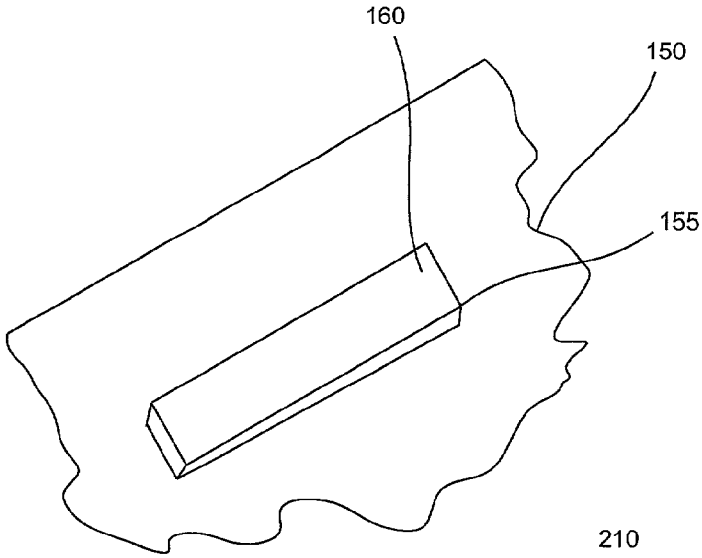
FIG. 1B is a cutaway view of a visual display unit illustrating a connection port of a visual display unit according to an exemplary embodiment.

FIG. 1B is a general block diagram illustrating a cutaway view of the back side of visual display unit 150, including display connection port 155. According to an exemplary embodiment, display connection unit 155 can include one or more identifier pins. In the exemplary embodiment of FIG. 1B, a single identifier pin 160 is used. Identifier pin 160 can be used to indicate to processing unit 110 the characteristics of the display module. Based on this information, processing unit 110 can update display driver and/or display controller 118 settings to facilitate communication with visual display unit 150. The display driver settings can include any type of settings related to the display such as event timing, color capability, resolution, or any other setting that can be used to facilitate communication. In an exemplary embodiment, characteristics of different types of displays may be stored within display controller 118. Each identifier pin 160 is representative of a bit used to identify a specific display. Accordingly, if a single identifier pin 160 is used, two different displays may be interchanged. If two pins are used, four display types may be interchanged, if three pins are used, eight display types may be interchanged, etc.

According to an exemplary alternative embodiment, the functionality of identifier pin 160 can be performed using an initialization signal. Upon indication that a new or alternative visual display is being utilized, a signal can be sent from processing unit 110 to visual display unit 150 requesting information representative of the properties of display unit 150. Further alternative embodiments can include any method wherein processing unit 110 is able to detect the properties of visual display unit 150. For example, visual display unit 150 may include a serial flash memory device that stores the display characteristics, including, but not limited to, display size, resolution, type, timings, and other settings. Such settings may be communicated from the memory device to display controller 118, via any of the pin connections, such as pin 160.

Advantageously, any processing unit that includes the disclosed system can be used with any visual display unit that includes the disclosed system and vice versa. The interchangeability of the units has the advantage of allowing a user to upgrade a processing unit or a visual display unit while avoiding the cost of replacing both units at the same time.

Further, a wide array of display types may be used with processing unit 110. Display types include, but are not limited to, monochrome displays, color displays, cathode ray tube (CRT) displays, projection displays, liquid crystal displays (LCDs), flat, rigid displays, flexible displays, electronic whiteboard displays, ruggedized displays, weather protected displays, waterproof displays, backlit displays, reflective displays, power saving displays, etc. Other display types well known in the art or not yet produced or conceived are equally applicable as detachable display types that may be used in the application described.

Ease of upgrade also provides an advantage to the manufacturer of a handheld computing device. New features and upgrades can be introduced at less total cost to the consumer. Therefore, new features and upgrades do not need to be as extensive to induce customers to purchase new models. This allows for a faster research to production to market cycle.

Figure 2:
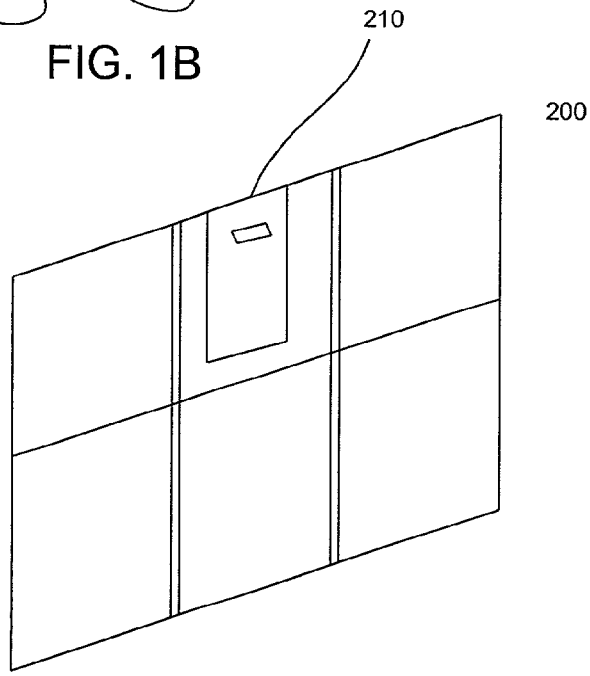
FIG. 2 is a generalized illustration of a handheld computing device including a processing unit and an alternative detachable visual display unit according to an exemplary embodiment.

FIG. 2 is a generalized illustration of a handheld computing device including processing unit 110 and an alternative display unit 200. Alternative display unit 200 is shown as a flexible, expandable display. Alternative display unit 200 can be any type of display having properties unique from visual display unit 150.

Alternative display unit 200 can include alternative connection port 210. Alternative connection port 210 is a connection port capable of communicating with connection port 130. Alternative connection port provides the functionality of connection port 155, described with reference to FIG. 1B.

Alternative display unit 200 can also utilize a system or method to indicate to processing unit 110 the properties of the display unit, similar to visual display unit 150, as described with reference to FIG. 1B.

Advantageously, alternative display unit 200 can allow the user of handheld computing device 100 to utilize a display unit that has properties that meet current needs. For example, a larger display, more colorful, higher resolution display could be used in an office setting for viewing large documents or photographs. In contrast, a smaller, compact display could be used while travelling. As depicted in FIG. 2, display 200 may be a foldable display that is capable of displaying data in a compact or stowed state or in an expanded state. Such foldable displays may be folded using hinged sections and/or may be formed of flexible display materials, e.g., e-paper and the like.

Figure 3:
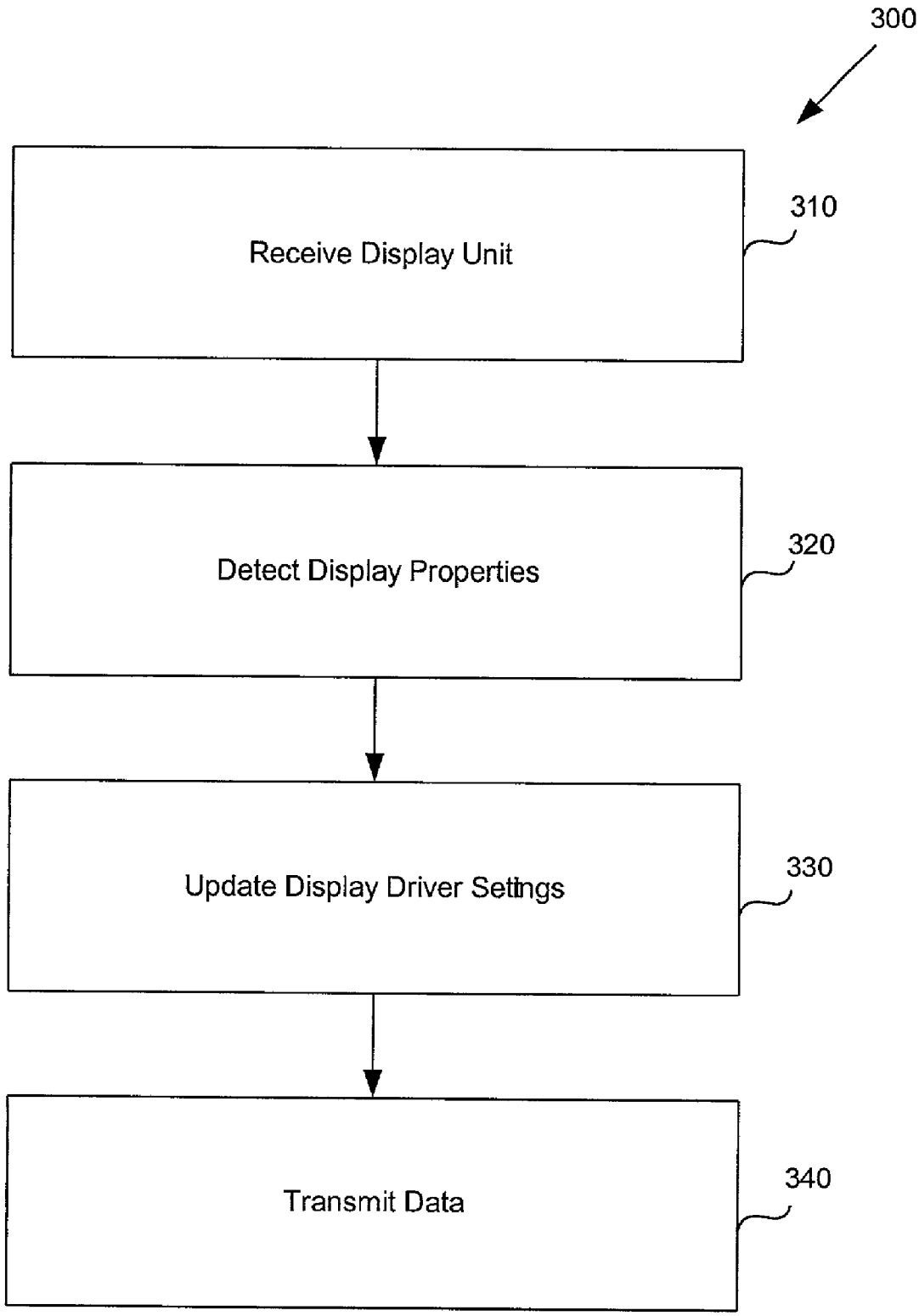
FIG. 3 is a flow diagram illustrating a process of communicating with a detached visual display unit according to an exemplary embodiment.

FIG. 3 is a flow diagram 300 illustrating a method of recognizing and utilizing visual display unit 150 according to an exemplary embodiment.

Processing unit 110 can receive a visual display unit 150 (step 310). Processing unit 110 can receive visual display unit 150 through connection port physical connection, through receiving a wireless signal transmitted by visual display unit 150, or any other method wherein there is an indication that a new visual display unit is being connected to receive data from processing unit 110.

Processing unit 110 can detect the properties of visual display unit 150 (step 320). The processing unit can detect the properties using identifier pin 160, described with reference to FIG. 1B, or using any other method for detecting properties. The properties detected can include resolution, color depth, event timing, or any other information to facilitate communication between processing unit 110 and visual display unit 150.

Processing unit 110 can update device driver settings based on information received in step 320 (step 330). Once this update, is performed, processing unit 110 can easily communicate with visual display unit 150. Following step 330, data can be transmitted to and from visual display unit 150 (step 340).

While the detailed drawings, specific examples and particular formulations given describe preferred and exemplary embodiments, they serve the purpose of illustration only. The inventions disclosed are not limited to the specific forms shown. For example, the methods may be performed in any of a variety of sequence of steps. The hardware and software configurations shown and described may differ depending on the chosen performance characteristics and physical characteristics of the computing devices. For example, the type of computing device, communications bus, or processor used may differ. The systems and methods depicted and described are not limited to the precise details and conditions disclosed. Furthermore, other substitutions, modifications, changes, and omissions may be made in the design, operating conditions, and arrangement of the exemplary embodiments without departing from the scope of the invention as expressed in the appended claims.

What is claimed is:

1. A handheld computing device comprising:

a processing unit having a communication interface, the processing unit including a first communication interface for communication with a visual display unit; and a detachable visual display unit, the detachable visual display unit communicatively coupled to the first communication interface by a second communication interface;

wherein an identifier indicia is passed by the second communication interface to the processing unit via the first communication interface to indicate to the processing unit the properties of the detachable visual display unit, wherein the first communication interface includes a wireless communication interface.

2. The handheld computing device of claim 1 wherein the detachable visual display unit includes a flat, rigid display.

3. The handheld computing device of claim 1 wherein the detachable visual display unit includes a flexible display.

4. The handheld computing device of claim 1, wherein the detachable visual display unit is expandable.

5. The handheld computing device of claim 1, wherein the detachable visual display unit includes a cathode ray tube display.

6. The handheld computing device of claim 1, wherein the detachable visual display unit includes a LCD screen.

7. The handheld computing device of claim 1, wherein the detachable visual display unit includes an electronic whiteboard.

8. The handheld computing device of claim 1, wherein the detachable visual display unit is ruggedized.

9. The handheld computing device of claim 1, wherein the detachable visual display unit is weather protected.

10. The handheld computing device of claim 1, wherein the detachable visual display unit includes a backlit display.

11. The handheld computing device of claim 1, wherein the detachable visual display unit includes a reflective display.

12. The handheld computing device of claim 1, wherein the detachable visual display unit includes a monochrome display.

13. The handheld computing device of claim 1, wherein the detachable visual display unit includes a color display.

14. A handheld computing device facilitating a detachable visual display unit comprising:

a processing unit;

a power source;

a communication port for communicating with a detachable visual display unit, wherein the communication port is capable of receiving information representative of properties of the detachable visual display unit, wherein the communication port includes a wireless transceiver.

15. The handheld computing device of claim 14, wherein the communication port receives information representative of the detachable visual display unit properties based on at least one identifier pin associated with the detachable visual display unit.

16. The handheld computing device of claim 14, wherein the communication port receives information representative of the detachable visual display unit properties based on an identifier signal transmitted by the detachable visual display unit.

17. The handheld computing device of claim 14, wherein the processing unit includes a plurality of display drivers utilized based on the information representative of the properties of the detachable visual display unit.

18. The handheld computing device of claim 14, wherein the wireless transceiver communicates using the Bluetooth wireless network protocol.

19. A visual display unit for a handheld computing device, the visual display unit comprising:

a housing detachable from the handheld computing device;

a display screen; and a wireless communication interface including an identifier indicia to indicate to a handheld computing device the properties of the visual display unit.

20. The visual display unit of claim 19, wherein the visual display unit is foldable to present a larger or smaller display screen.

21. The visual display unit of claim 20, wherein the visual display unit includes an apparatus to anchor the visual display unit to the handheld computing device.

22. The visual display unit of claim 19, wherein the display screen is color.

23. A method of displaying data from a handheld computing device, comprising:

detecting the properties of a detachable visual display unit wirelessly communicatively coupled to the handheld computing device;

updating display drivers based on the detachable visual display unit properties detected; and transmitting data from the handheld computing device to the communicatively coupled detachable visual display unit.

24. The method of claim 23, wherein detecting the properties of a detachable visual display unit includes receiving a signal transmitted by the detachable visual display unit.

25. The method of claim 23, further comprising:

bringing the detachable visual display unit into communication with the handheld computer device.

26. The method of claim 25, further comprising:

detaching the detachable visual display unit from the handheld computing device.

* * * * *